United States Patent [19]

Honeycutt, Jr. et al.

[11] 4,155,780

[45] May 22, 1979

[54] METHOD FOR PRESTRESSING TURBINE DISKS

[75] Inventors: Fred L. Honeycutt, Jr., Lake Park; Myron C. Starr, Jupiter, both of Fla.

[73] Assignee: The United States of America as represented by the Secretary of the Air Force, Washington, D.C.

[21] Appl. No.: 866,185

[22] Filed: Dec. 30, 1977

[51] Int. Cl.[2] ..... C22F 1/00

[52] U.S. Cl. ..... 148/13.1; 148/14

[58] Field of Search ..... 148/13.1, 13.2, 14, 148/149, 13, 134

[56] References Cited

U.S. PATENT DOCUMENTS 3,558,367 1/1971 Eck ..... 148/149

*Primary Examiner*—R. Dean

*Attorney, Agent, or Firm*—Joseph E. Rusz; Henry S. Miller, Jr.

[57] ABSTRACT

A method for adding a residual compressive stress to the rim of a turbine disk by heating the disk to a uniform high temperature, then insulating the rim from the remainder of the disk and cooling to a temperature wherein the rim yields in tension.

1 Claim, 1 Drawing Figure

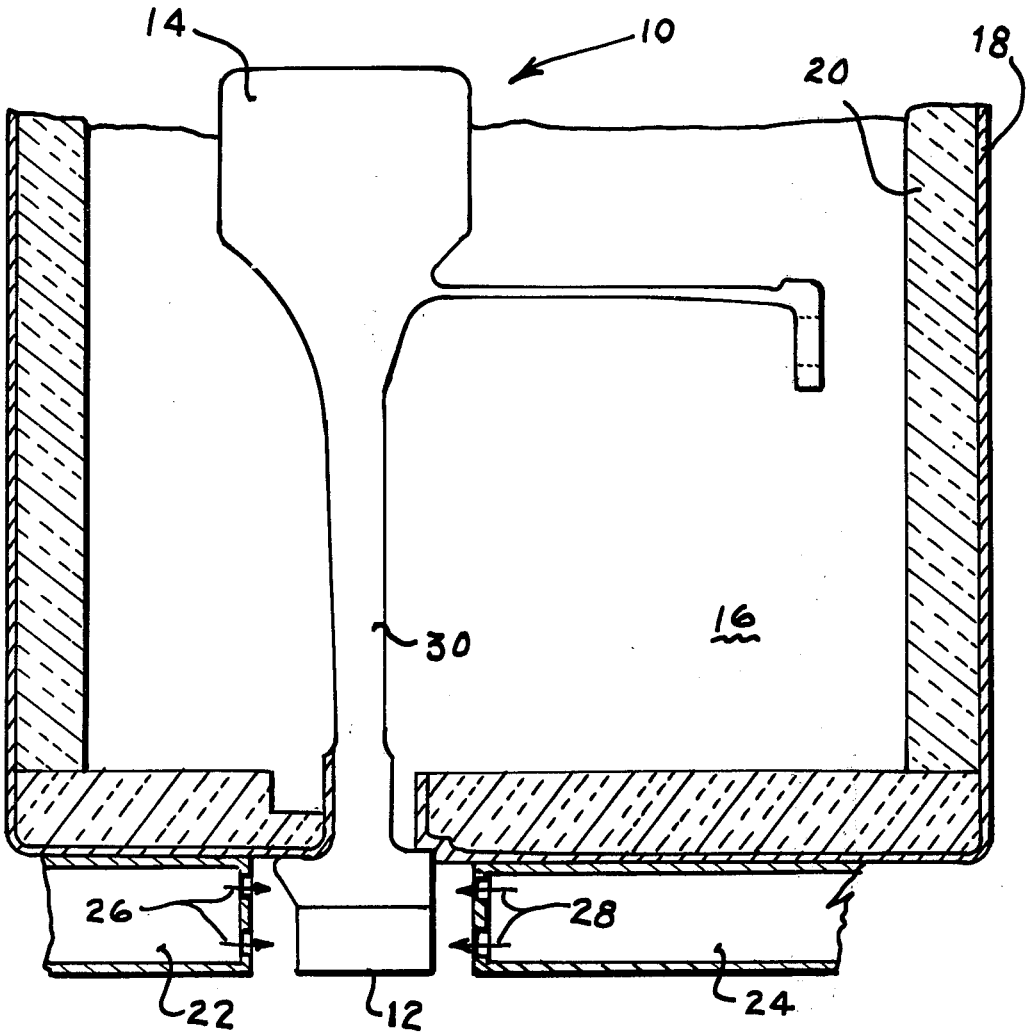
14
10
18
20
30
16
26
28
22
12
24

METHOD FOR PRESTRESSING TURBINE DISKS

STATEMENT OF GOVERNMENT INTEREST

The invention described herein may be manufactured and used by or for the Government for governmental purposes without the payment of any royalty thereon.

In order to obtain maximum utilization from turbines their components must be formed of the best materials and manufactured with the best possible process. One method for measuring the quality of a turbine disk is to consider the Low Cycle Fatigue (LCF) life of the disk at different points. These points are usually designated where there is likelihood of failure. One such point, for example, is at the rim cooling air hole location on the disk.

Conventionally, LCF life is increased by adding mass to the disk bore; in the case of a first stage turbine disk used in a high performance augmented turbofan engine, approximately five pounds is added. In adding mass to the disk bore, the disk rim tangential stress is reduced, thereby increasing LCP life. The addition of weight to the turbine, particularly in aircraft turbines, is detrimental to its operation and is not a desirable solution to the problem.

The equations used to determine LCF life are based upon tangential stress, or $$\sigma \text{ steady} = \frac{\sigma \text{ tang.}}{2}$$

$$\sigma \text{ cyclic} = \frac{\sigma \text{ tang.}}{2}$$

These two stress values may be then entered on a LCF diagram (curve) to determine LCF life. The curve would show that a decrease in either steady or cyclic stress or both will increase the predicted LCF life.

SUMMARY OF THE INVENTION

One method of decreasing the steady stress is to add a residual compresive stress to the disk rim. Adding a residual compressive stress will also reduce the tangential stress.

The concept of residual stress involves adding a compressive stress on the disk rim during manufacture rather than "0" residual stress, which is normally attempted. A compressive stress will reduce disk rim stresses during operations, thereby increasing LCF life.

As an example, if, during the manufacturing process, a 10,000 psi residual compressive stress is induced on a disk that normally experiences 70,000 psi, the net result will be a 60,000 psi stress although the stress range remains the same.

| RIM CONDITION | STRESS RANGE | MAXIMUM STRESS |
|---|---|---|
| "0" residual | 70,000 psi | 70,000 psi |
| 10,000 psi residual | 70,000 psi | 60.000 psi |

The LCF equations become:

$$\sigma \text{ steady} = \frac{\sigma \text{ tang} + \sigma \text{ resid}}{2} = \frac{\sigma \text{ tang} - 10{,}000}{2}$$

$$\sigma \text{ cyclic} = \frac{\sigma \text{ tang} - \sigma \text{ resid}}{2} = \frac{\sigma \text{ tang} + 10{,}000}{2}$$

The method for achieving this residual compressive stress involves heating the turbine disk uniformly to a temperature sufficiently high that through proper rim cooling techniques a thermal gradient can be induced between the rim and disk bore. After the disk has reached the uniform high temperature, one means of doing this is to insulate the disk rim from the remainder of the disk, and cool the disk rim through the use of cooling air, for example. When the disk rim has cooled to a predetermined temperature, a thermal gradient is induced between the rim and disk web. The resulting thermal stress must be of such magnitude that the rim yields in tension. Removing the insulation and allowing the disk to cool uniformly to room temperature will leave a residual compressive stress in the disk rim.

It is therefore an object of the invention to provide a new and improved method for prestressing turbine disks.

It is another object of the invention to provide a new and improved method for prestressing turbine disks that causes increased low cycle fatigue life.

It is a further object of the invention to provide a new and improved method for prestressing turbine disks that is low in cost and easily implemented.

It is still another object of the invention to provide a new and improved method for prestressing turbine disks that would provide a residual compressive stress in the disk rim.

It is still a further object of the invention to provide a new and improved method for prestressing turbine disks without adding weight.

These and other advantages, features and objects of the invention will become more apparent from the following description when taken in conjunction with the illustrative embodiment in the accompanying drawing.

DESCRIPTION OF THE DRAWING

The FIGURE is a side elevational view partly in section of a means for performing the method of the invention.

DETAILED DESCRIPTION OF THE PREFERRED EMBODIMENT

Referring now to the FIGURE, a turbine disk is shown generally at 10. The rim of the disk is shown at 12 with the bore at 14. With the exception of the rim, the disk is placed in housing 16, consisting of rigid walls 18, having a layer of thermal insulation 20 affixed thereto. Attached to one wall of the housing are ducts 22 and 24 designed to direct cooling air toward the disk rim by allowing the air to escape through holes 26 and 28. The housing is so constructed that it would open into two or more sections for insertion and removal of the disk.

The process for prestressing the rim of a IN 100, turbine disk uniformly at 1200° F. while insulating the disk rim 12. After the disk reaches AN equilibrium temperature, cooling air is directed through ducts 22 and 24 onto the rim 12. As the rim temperature approaches 200° F., the thermal gradient between the cool rim and hot disk bore (14) is sufficiently high that the strain created yields the rim in tension.

The insulation is then removed and the disk is allowed to cool uniformly. Since the rim has yielded in tension already, it will be pulled into compression as the web 30 cools, leaving a residual stress in the rim.

Although the invention has been described with reference to a particular embodiment, it will be understood to those skilled in the art that the invention is capable of a variety of alternative embodiments within the spirit and scope of the appended claims

We claim:

1. A process for adding a residual compressive stress to the rim of a turbine disk comprisng the steps of: insulating the disk rim from the remainder of the disk; heating the disk uniformly to 1200° F.; when the disk reaches an equilibrium temperature applying a cooling fluid to the disk rim; cooling the rim to 200° F.; removing the insulation and cooling the rim uniformly, whereby a residual compressive stress is induced in the disk rim.

* * * * *